United States Patent [19]

Yamaguchi et al.

[11] 4,188,211

[45] Feb. 12, 1980

[54] THERMALLY STABLE AMORPHOUS MAGNETIC ALLOY

[75] Inventors: Norishige Yamaguchi; Kazuo Ohya; Osamu Kohmoto; Hiroki Fujishima, all of Tokyo, Japan

[73] Assignee: TDK Electronics Company, Limited, Tokyo, Japan

[21] Appl. No.: 876,528

[22] Filed: Feb. 9, 1978

[30] Foreign Application Priority Data

Feb. 18, 1977 [JP] Japan ..... 52-16816
Feb. 24, 1977 [JP] Japan ..... 52-19460

[51] Int. Cl.[2] ..... C22C 19/00; C22C 19/05

[52] U.S. Cl. ..... 75/170; 75/171; 148/31.55

[58] Field of Search ..... 75/170, 171, 122, 134 F; 148/31.55, 31.57, 100

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 75/122 |
| 3,986,867 | 10/1976 | Masumoto et al. | 75/134 F |
| 4,038,073 | 7/1977 | O'Handley et al. | 75/170 |
| 4,052,201 | 10/1977 | Polk et al. | 75/122 |
| 4,056,411 | 11/1977 | Chen et al. | 148/108 |
| 4,067,732 | 1/1978 | Ray | 75/126 H |
| 4,079,430 | 3/1978 | Fujishima et al. | 360/125 |

FOREIGN PATENT DOCUMENTS

| | | | |
|---|---|---|---|
| 2405036 | 8/1974 | Fed. Rep. of Germany | 75/122 |

*Primary Examiner*—Arthur J. Steiner
*Attorney, Agent, or Firm*—Burgess, Ryan and Wayne

[57] ABSTRACT

During investigation of thermal stability of the amorphous magnetic alloys by the Inventors, it was discovered that, due to the application of heat to the alloys, the hysteresis loop of the conventional, amorphous magnetic alloys was shifted in such a manner that the initial permeability of the alloys was decreased. It was also discovered that the initial permeability of the conventional amorphous magnetic alloys was irreversibly changed due to the application of heat to and the withdrawal of heat from the alloys.

The present invention is characterized by the discovery of an unexpected relationship between the content of metallic elements and a metalloid element(s) of the amorphous alloy composition, thereby providing novel alloy compositions with thermally stable magnetic properties.

The present invention is also characterized by incorporating an additional element or elements into an amorphous magnetic alloy, thereby providing the alloy with thermal stability.

42 Claims, 4 Drawing Figures

THERMALLY STABLE AMORPHOUS MAGNETIC ALLOY

The present invention relates to an amorphous magnetic alloy.

Although metals are normally crystalline in the solid state, solid amorphous alloys having an atomic arrangement similar to as that in a liquid state can be obtained when a melt of specific kinds of alloys is rapidly quenched at a high cooling rate ranging from $10^4$ to $10^6$° C. per second and then solidified. Since the amorphous metal does not exhibit diffraction patterns during X-ray diffraction measurements or electron diffraction measurements, it can then be deduced that the atomic arrangement of the amorphous alloy is random and different from that of the crystalline metal.

In the U.S. Pat. application Ser. No. 656,864 now U.S. Pat. No. 4,079,430 and German Laid-Open Specification No. 26 05 615, some of the Inventors proposed a magnetic head, wherein the magnetic body thereof is an amorphous metal alloy of the general formula:

$$M_aY_b$$

wherein M is at least one metal selected from the group consisting of iron, nickel and cobalt, Y is at least one element selected from the group consisting of phosphorous, boron, carbon and silicon, and wherein the percentage of the components M and Y represented by the atomic percentages in a and b are selected from the range of about 60 to about 95 and from the range of 5 to 40, respectively, with the proviso that a plus b equals 100. In the Patent Application mentioned above, the following amorphous alloys were tested:

$Fe_{80}P_{13}C_7$ $Fe_{45}Ni_{47}P_8$ $Co_{79}P_{21}$ $Fe_{80}P_{13}B_7$ $Fe_{40}Ni_{40}P_{14}B_6$.

After testing, the amorphous alloy having the formula $M_aY_b$ was found to have a low coercive force, a high initial permeability, a high electric resistance and hardness, because the amorphous alloy did not exhibit magnetic anisotropy which is inherent in a normal crystal. The amorphous alloy of the formula $M_aY_b$ was therefore found to be suited for use as a soft magnetic material.

The amorphous, magnetic alloys having the following compositions are also known in the field of magnetic materials to have high initial permeability.

$Fe_{4.7}Co_{70.3}Si_{15}B_{10}$ $Fe_6Co_{74}B_{20}$

The amorphous alloys having these known compositions and the amorphous alloys having the above-described tested composition disclosed in the U.S. patent application Ser. No. 656,864 were discovered by the present Inventors to have excellent magnetic properties only at around room temperature. When these amorphous alloys were heated for a few hours at a temperature of approximately 200° C., the initial permeability of these alloys measured after heating at room temperature was then reduced by 60 to 80% based on the permeability at room temperature before heating. Accordingly, the magnetic properties of these amorphous alloys are considered to be thermally unstable.

A person skilled in the art is aware that the initial permeability of $Fe_5Co_{70}Si_{15}B_{10}$ at room temperature was reduced to one-sixth of its initial value by heating this alloy at 300° C.

The Inventors directed their attention to the importance of the thermal stability of the amorphous alloy, which is used as, for example, a magnetic head. By using the known amorphous alloys of $Fe_{4.7}Co_{70.3}Si_{15}B_{10}$ and $Fe_6Co_{74}B_{20}$, the present Inventors produced a magnetic head by using the following procedures. The amorphous alloys were first formed into sheets so as to reduce the eddy current loss of these alloys. A large number of the amorphous alloy sheets were laminated by placing a bonding agent therebetween and then by heating at a temperature from 100 to 200° C. A pair of the laminated sheets were shaped into a half ring form and coupled to one another by placing an insert therebetween. The coupled sheets were immersed in a resin, which was contained in a casing, and then, heated to approximately 100° C. for 3 hours, thereby securing the sheets to the casing by the aid of the resin. As a result of the heating, the initial permeability of the laminated amorphous alloy sheets was reduced from approximately 10,000 to values ranging from 2,000 to 3,000. Accordingly, the initial permeability of the magnetic head, i.e. the laminated sheets of the amorphous alloy, was formed to be insufficient for using the sheets for a magnetic head.

It was also discovered by the present Inventors that the amorphous magnetic alloys having the following compositions and used as soft magnetic materials, i.e. $Fe_{80}P_{13}C_7$, $Fe_{45}Ni_{47}P_8$, $Co_{79}P_{21}$, $Fe_{80}P_{13}B_7$, $Fe_{40}Ni_{40}P_{14}B_6$, $Fe_{4.7}Co_{70.3}Si_{15}B_{10}$, and $Fe_6Co_{74}B_{20}$, presented some serious problems, because the initial permeability of these alloy compositions decreases responsively depending upon the extent of the temperature increase from room temperature, and furthermore, the value of the decreased initial permeability cannot be restored to its original value even after the temperature is decreased to the original room temperature. If these alloy compositions are used for producing a magnetic material, the material will not be satisfactory due to the above-described irreversible decrease of the initial permeability.

It is, therefore, an object of the present invention to provide a thermally stable, amorphous magnetic alloy, which does not exhibit a large reduction of the initial permeability when heated at a temperature higher than room temperature.

It is another object of the present invention to provide a thermally stable, amorphous magnetic alloy, which can be reliably made into an electrical device, such as a magnetic head, by processing at a temperature which is higher than room temperature.

It is still another object of the present invention to provide an amorphous magnetic alloy which does not exhibit a large decrease or irreversible decrease of the initial permeability upon heating above room temperatures.

Figure 1:
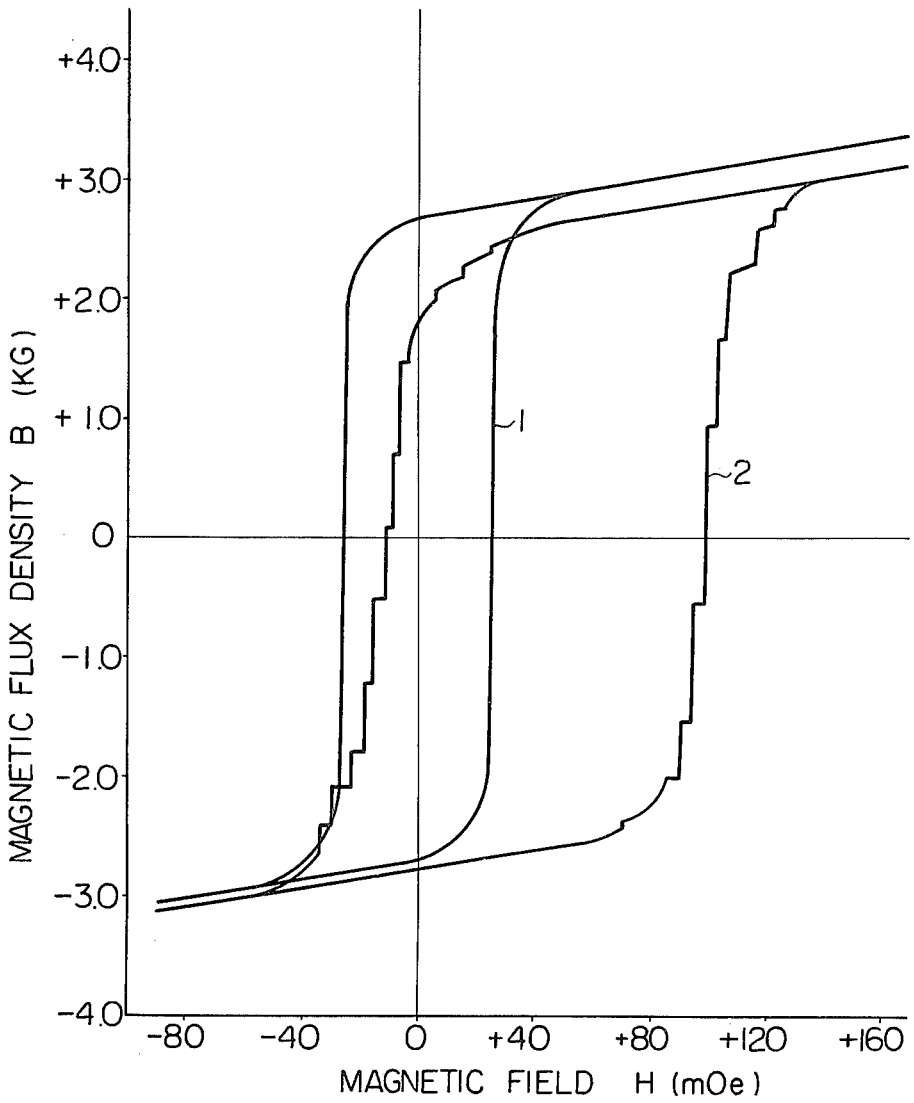
FIG. 1 is an illustration of the change in hysterisis loop exhibited by a prior art alloy after heating at 200° C. for one hour.

As is known in this technical field, an amorphous alloy is changed to a crystalline alloy when heated to a high temperature. The reduction of the initial permeability by heating the amorphous alloy occurs, however, at a temperature considerably lower than the transition temperature at which the alloy changes from the amorphous state to the crystalline state. The Inventors investigated the reason for the occurrence of reduction of initial permeability at a temperature below the crystallization temperature of the amorphous alloy by performing various experiments and discovered that, as shown in FIG. 1, the hysteresis loop of the amorphous alloy was shifted as seen in FIG. 1 by heating the alloy. In FIG. 1, the amorphous alloy of the composition $(Fe_{0.07}Co_{0.85}Ni_{0.08})_{75}Si_{15}B_{10}$ exhibits, prior to heating the alloy, the hyteresis loop denoted as 1, while the same alloy, after heating at 200° C. for an hour, exhibits the hysteresis loop denoted as 2. It is, therefore, apparent that the coercive force of the amorphous alloy was increased, i.e., shifted by several tens of mOe.

The present inventors, therefore, conducted research for preventing a shift of the hysteresis loop, as stated above, and unexpectedly discovered the following amorphous alloy.

An amorphous alloy, according to the present invention, is expressed by the general formula:

$$(Fe_aCo_bNi_c)_x(Si_eB_f)_y \quad (1)$$

wherein, a, b and c are the molar fractions of iron, cobalt and nickel, respectively, with the proviso that $a+b+c=1.00$; e and f are the molar fractions of silicon and boron, respectively, with the proviso that $e+f=1.00$; x is the atomic percent of the iron, cobalt and nickel; and y is the atomic percent of the silicon and boron, based on the alloy, respectively; and further, the values a, c, e, f and y are limited to ranges defined by the following relationships:

$$0.03 > a \leqq 0.12 \quad (2)$$

$$0 \leqq c \leqq 0.60 \quad (3)$$

$$27.5-8c \leqq y \leqq 35-19C \quad (4)$$

$$0 \leqq ey \leqq 25, \text{ and} \quad (5)$$

$$0 \leqq fy \leqq 30. \quad (6)$$

The molar fractions mentioned above indicate the number of atoms for each element, with the proviso that the total number of all of the elements in the group of either Fe, Co and Ni or in the group of Si and B be expressed by 1.0.

The above formula (4) indicates the relationship discovered by the present Inventors which exists between Ni and both Si and B. Both Si and B are known to help create an amorphous alloy state and may be referred to, hereinafter, as metalloid components. The relationship indicated by formula (4), according to a feature of the present invention, implies that when the Ni content (c) is decreased, the amount of the metalloid components (y) should be increased. On the other hand, when the Ni amount (c) is increased, the amount of the metalloid components (y) should be decreased.

The content of nickel (c) in the transition-metal components of nickel, cobalt and iron, should be from 0 to 0.60, according to formula (3), but should perferably be from 0 to 0.30. When the nickel content (c) exceeds 0.60, the saturation-magnetization of the amorphous alloy is too low.

Figure 2:
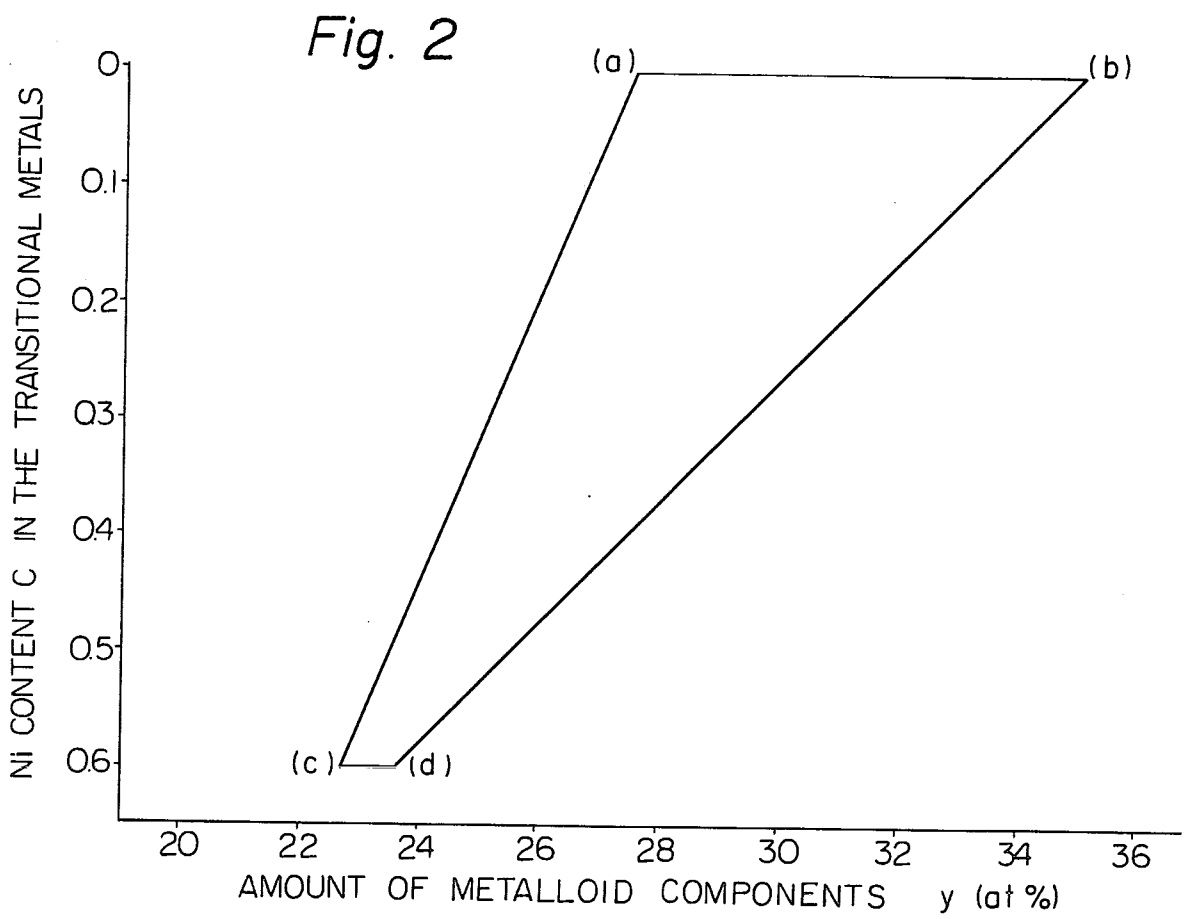
FIG. 2 illustrates the relationship between the nickel content (C) and the metalloid content (Y) of the alloys of the present invention.

FIG. 2 is a graph showing the composition range of an amorphous alloy according to the present invention, wherein the amount of the metalloid components (y) is plotted on the abscissa and the nickel content (c) is plotted on the ordinate. In FIG. 2, the horizontal line determined by points (a) and (b), corresponds to a minimum nickel content (c) of 0, and the horizontal line determined by points (c) and (d) corresponds to the maximum nickel content (c) of 0.60. The line determined by points (c) and (a) corresponds to the expression 27.5−8c of the formula (4), and the line determined by the points (d) and (b) corresponds to the expression of 35−19c of the formula (4).

The area within the geometric Figure determined by the lines (a) (b), (b) (d), (d) (c), and (c) (a) corresponds to the amounts of nickel (Ni) and metalloid components (B and Si), wherein excellent magnetic properties of the amorphous alloy are provided. When y is smaller than the value determined by 27.5−c (line (a) (c), the magnetic properties of the amorphous alloy are quite thermally unstable. When y is larger than the value determined by 35−c (line (b) (d), the saturation magnetic flux density of the amorphous alloy is insufficient for magnetic materials and the magnetic properties of the amorphous alloy are quite thermally unstable.

When the iron content (a), in terms of the molar fraction of the transitional metal components of iron, cobalt and nickel, does not fall within the range of from 0.03 to 0.12, it is not possible to select the amorphous alloy composition within such a range that the magnetic properties of the alloy are maintained in a thermally stable state, and, further, the magnetostriction of the alloy is low. Due to the high magnetostriction of the amorphous alloy having the composition not falling within the above-mentioned range of 0.03 to 0.12, the initial permeability of the alloy is decreased. As a result, the property required for a magnetic material is not provided by such an alloy.

Accordingly, a preferable iron content (a) for this alloy is that from 0.04 to 0.09.

The content of silicon in the amorphous alloy should be from 0 to 25 atomic % according to the above formula (5). However, the silicon content should preferably be from 5 to 20 atomic %. A silicon content of 25 atomic % or lower helps to form an amorphous alloy structure and also contributes to increasing the wear resistance of the alloy. However, when the silicon content exceeds 25 atomic %, it then becomes difficult to produce an amorphous alloy in accordance with the present level of the known technique, because the presently obtainable cooling rate is generally from $10^4$ to $10^6$° C./second. In addition, when the silicon content exceeds 25 atomic %, the alloy becomes brittle.

The formula (6) indicates that the content (fy) of boron in the amorphous alloy should be within the range of from 0 to 30 atomic %, like silicon, a boron content of 30 atomic % or lower helps to form an amorphous alloy. However, when the boron content exceeds 30 atomic %, it is difficult to obtain an amorphous alloy, and the alloy becomes brittle.

Preferred alloys with high initial permeability are as follows.

$$(Fe_{0.07-0.08}Co_{0.62-0.63}Ni_{0.30})_{71-73}(Si_eB_f)_{27-29}$$

$$(Fe_{0.09-0.10}Co_{0.30-0.46}Ni_{0.45-0.60})_{76-74}(Si_eB_f)_{24-26}$$

Another amorphous alloy according to the present invention is expressed by the general formula:

$$(Fe_aCo_bNi_c)_x(Si_eB_fP_gC_h)_y,$$

wherein, a, b and c are the molar fractions of iron, cobalt and nickel, respectively, with the proviso that $a+b+c=1.00$; e, f, g and h are the molar fractions of silicon, boron, phosphorous and carbon, respectively, with the proviso that $e+f+g+h=1.00$; x is the atomic % of iron, cobalt and nickel; and y is the atomic % of silicon, boron, phosphorus and carbon, and further, the values of a, c, e, f, g, h and y are limited to ranges defined by the following relationships:

$$0.03 \leqq a \leqq 0.12; \quad (2)$$

$$0 \leqq c \leqq 0.60; \quad (3)$$

$$27.5-8c \leqq y \leqq 35\ 19c; \quad (4)$$

$$0 \leqq ey \leqq 25; \quad (5)$$

$$0 \leqq fy \leqq 30, \text{ and}; \quad (6)$$

$$0 < (g+h) \leqq 0.8(e+f). \quad (7)$$

The other amorphous alloy mentioned above is characterized by the fact that silicon and/or boron is partially replaced by either phosphorous or carbon, or both, in an amount not exceeding 0.80, and preferably not exceeding 0.50 molar fraction based on the original total amount of silicon and boron.

Phosphorous and carbon which replace silicon and/or boron help to make an alloy amorphous. However, when the total contents of phosphorous and carbon exceeds 28 atomic % based on the alloy, the saturation magnetic flux density of the alloy is too low. In order to prevent a decrease in the saturation magnetic flux density, the replaced amount should not exceed the above-mentioned 0.80 molar fraction.

Another amorphous magnetic alloy according to the present invention is expressed by the general formula:

$$(Fe_aCo_bNi_c)_x(Si_eB_f)_y,$$

wherein, a, b and c are the molar fractions of iron, cobalt and nickel, respectively, with the proviso that $a+b+c=1.00$; e and f are the molar fractions of silicon and boron, respectively, with the proviso that $e+f=1.00$; x and y are the atomic % of the iron, cobalt and nickel and the silicon and boron, respectively, based on the above general formula, and, further, the values a, b, e, f and y are limited to range defined by the following relationships:

$$0.03 \leqq a \leqq 0.12; \quad (8)$$

$$0.40 \leqq b \leqq 0.85; \quad (9)$$

$$20 \leqq y \leqq 35; \quad (10)$$

$$0 \leqq ey \leqq 25, \text{ and}; \quad (11)$$

$$0 < fy \leqq 30; \quad (12)$$

and, still further, at least one element selected from the group consisting of Ti, Zr, V, Nb, Ta, Cr, Mo, W, Zn, Al, Ga, In, Ge, Sn, Pb, As, Sb and Bi is added in an amount of from 0.5 to 6.0 atomic % based on the total components of the amorphous alloy into the alloy expressed by the general formula. In this group of elements Nb, Ta, W and In are preferable, and Ge and Mo are more preferable.

The second alloy mentioned above has the characteristic feature wherein the magnetic properties of the alloy are thermally stable and, particularly, the dependence of the initial permeability upon temperature at around room temperature is decreased and linear.

When the iron content (a), in terms of the molar fraction in the transitional metal components of iron, cobalt and nickel, does not fall within the range of from 0.03 to 0.12, it is not possible to select the composition of the amorphous alloy within such a range that the magnetic properties of the alloy are maintained in a thermally stable state, and, further, the magnetostriction of the alloy is low. Due to high magnetostriction of the amorphous alloy having the composition not falling within the range of from 0.03 to 0.12, mentioned above, initial permeability of the alloy is decreased. As a result, the property required for producing a magnetic material is not provided by such an alloy. Accordingly, a preferable iron content for this alloy is that from 0.04 to 0.09.

When the cobalt content (b), in terms of the molar fraction in the transitional metal components of iron, cobalt and nickel, is smaller than 0.40, the saturation magnetic flux density is decreased. On the other hand, when the cobalt content (b) exceeds 0.85, neither thermal stability nor the temperature dependence of the initial permeability is improved by the addition of at least one of the elements selected from the group consisting of Ti, Zr, V, Nb, Ta, Cr, Mo, W, Zn, Al, Ga, In, Ge, Sn, Pb, As, Sb and Bi into the amorphous magnetic alloy. A preferable cobalt content is from 0.40 to 0.70.

When the content (y), in terms of atomic % of the metalloid component, i.e. $Si_eB_f$, is smaller than 20%, it becomes impossible to provide an amorphous magnetic alloy with both thermal stability and an excellent dependence of the initial permeability upon temperature. On the other hand, when the silicon content exceeds 25 atomic %, it then becomes difficult to produce an amorphous alloy in accordance with the present level of the known technique, because the presently obtainable cooling rate of a melt is generally from $10^4$ to $10^6$° C./second.

The content of silicon in the amorphous alloy should be from 0 to 25 atomic % according to the formula (11). According, the silicon content should preferably be from 5 to 20 atomic %. A silicon content of 25 atomic % or lower helps to form an amorphous alloy structure and also contributes to increasing the wear resistance of the alloy. However, when the silicon contents exceeds 25 atomic %, it then becomes difficult to produce an amorphous alloy. The amorphous magnetic alloy according to the present invention may contain no silicon and instead includes only boron as the metalloid component. If the amount of boron to be included does not exceed 30 atomic %, the boron can also help to form an amorphous alloy structure.

However, if the boron contents exceeds 30 atomic %, then it becomes difficult to make an amorphous alloy and, in addition, the alloy becomes brittle.

Elements such as Ti, Zr, V, Nb, Ta, Cr, Mo, W, Zn, Al, Ga, In, Ge, Sn, Pb, As, Sb and Bi, hereinafter referred to as additional elements, according to a feature of the present invention, suppress degradation of the magnetic properties of the amorphous alloy due to heating to a temperature lower than the crystallization temperature. When the alloy is heated to a temperature of approximately 100° C., these elements suppress particularly the decrease of initial permeability of the amorphous alloy. These elements also suppress the irreversibility of the initial permeability when the amorphous alloy is heated to a temperature of approximately 100° C.

The atomic percent of the above-mentioned additional elements, such as Ti, Zr and others, is based on the number of atoms of all of the elements Fe, Co, Ni, Si, B and the number of atoms of these additional elements. If the content of the additional elements is smaller than 0.5 atomic %, it is impossible to improve the thermal instability of the magnetic properties. On the other hand, if the contact of the additional elements is greater than 6.0 atomic %, due to the increase of the additional elements it becomes gradually impossible to provide the alloy with an amorphous structure. Furthermore, the saturation flux density is decreased, with the result being that the magnetic properties of the amorphous alloy, are not sufficient for producing a magnetic material. A preferable content of the additional elements is from 0.5 to 3 atomic %.

A further amorphous alloy according to the present invention is expressed by the general formula:

$$(Fe_aCo_bNi_c)_x(Si_eB_fP_gC_h)_y,$$

wherein, a, b and c are the molar fractions of iron, cobalt and nickel, respectively, with the proviso that $a+b+c=1.00$, e, f, g and h are the molar fractions of silicon, boron, phosphorous and carbon, respectively, with the proviso that $e+f+g+h=1.00$; x is the atomic % of the iron, cobalt and nickel; and y is the atomic % of the silicon, boron, phosphorous and carbon, and further, the values a, b, e, f, g and y are limited to ranges defined by the following relationships:

$$0.03 \leqq a \leqq 0.12; \quad (8)$$

$$0.40 \leqq b \leqq 0.85; \quad (9)$$

$$0 \leqq ey \leqq 25; \quad (13)$$

$$0 \leqq fy \leqq 30, \text{ and}; \quad (14)$$

$$0 < (g+h) \leqq 0.8\ (e+f). \quad (15)$$

and, still further, at least one element selected from the group consisting of Ti, Zr, V, Nb, Ta, Cr, Mo, W, Zn, Al, Ga, In, Ge, Sn, Pb, As, Sb and Bi is added in an amount from 0.5 to 6 atomic % based on the total components of the amorphous alloy into the alloy expressed by the general formula. This alloy is characterized by the partial replacement of Si and/or B with P and/or C and by the inclusion of an additional metal into the amorphous alloy.

To distinguish an amorphous substance from a crystalline substance, X-ray diffraction measurement is generally employed. In this regard, an amorphous alloy produces a halo diffraction, but does not have sharp diffraction peaks which are reflected from the lattice planes of crystals formed in an equilibrium state. It is, therefore, possible to calculate the ratio of observed height of peaks with respect to the theoretical height of the known standard peaks of crystals. The degree of amorphousness is expressed in terms of this ratio. The amorphous alloy according to the present invention is essentially amorphous, since it has a degree of amorphousness of 50% or more and in preferred cases, 75% or more.

A process for producing amorphous, magnetic alloys according to the present invention is hereinafter described. It is possible to produce thermally stable, amorphous, magnetic alloys by super-rapidly cooling an alloy melt, in a molten state to a solidified state at a cooling rate higher than $10^{4c}$ C./second.

Figure 3:
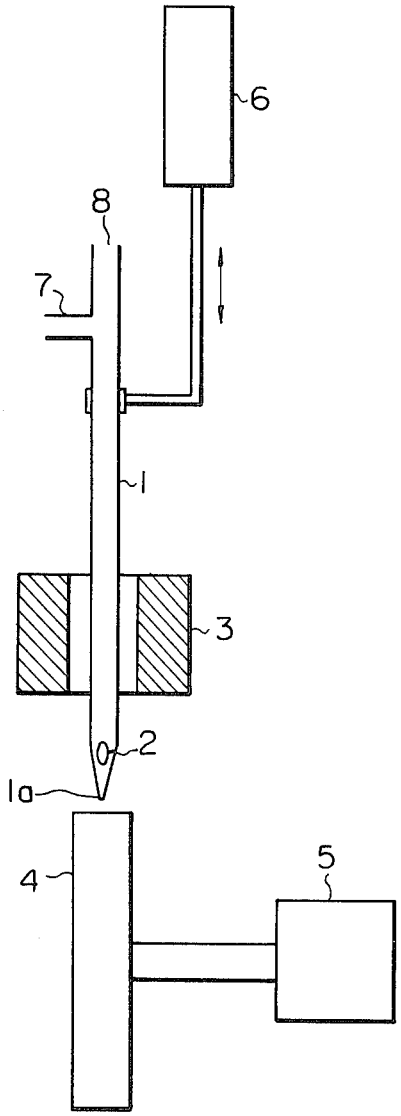
FIG. 3 is a schematic representation of an apparatus for rapidly cooling the alloys of the present invention to prepare them in an amorphous form.

FIG. 3 schematically illustrates an apparatus for carrying out super-rapid cooling of alloy from a molten state in order to produce an amorphous alloy. A quartz tube 1 is tapered at its lower end 1*a*. The tapered lower end 1*a* functions as a nozzle for injecting a molten alloy into the tube. An alloy specimen 2 is placed in the nozzle part 1*a* and melted by a furnace 3. On the upper wall of the quartz tube 1 there is provided an opening for introducing an inert gas, such as argon gas, into the tube at a low pressure. During melting, the inert gas prevents the alloy specimen 2 from being oxidized. The rotatable metal roller 4 for a super-rapid cooling of the molten metal is rotated by means of a motor 5, at a high speed equal to a circumferential speed of more than 20 m/sec. The pneumatic piston 6 supports the quartz tube 1, and moves the tube in a vertical direction.

The operation of the apparatus illustrated in FIG. 3 is performed as follows. An alloy specimen is inserted from the upper end 8 into the lower end 1*a* of the quartz tube 1. The alloy specimen 2 is positioned at the middle level of the furnace 3. Thereafter, the specimen 2 is well melted in an argon atmosphere, such argon being introduced into the quartz tube 1 provided with a nozzle through the opening 7. The pneumatic piston 6 is then driven to lower the quartz tube 1 provided with a nozzle at the end of the tube 1 into the position shown in FIG. 3. The lower end of the nozzle is now positioned in the proximity of the circumference of the high speed rotating roller 4. Subsequently, an inert gas of a high pressure is introduced from the upper end 8 into the quartz tube, for injecting a molten alloy onto the circumference of the high-speed rotating roller 4. The molten alloy is, consequently, super-rapidly cooled in order to obtain the desired amorphous alloy. The resultant amorphous alloy is in the form of a ribbon having a thickness of approximately 20 microns to 60 microns.

When heat is not applied to amorphous magnetic materials, the materials exhibit no magnetic anisotropy, and thus exhibit high permeability. The known amorphous magnetic materials were, however, disadvantageous in the fact that the initial permeability of the materials was greatly decreased due to heating the amorphous materials to a temperature of from 100° to 200° C. According to the present invention, the disadvantageous thermal instability of the amorphous materials is removed. The magnetostriction of the amorphous alloy compositions can be suppressed to $1\times10^{-6}$ or lower, because the alloy composition of the present invention exhibits thermally stable magnetic properties and further, all of the amorphous alloys exhibit no magnetic anisotropy. It is therefore possible to provide a practical and employable soft magnetic material which exhibits excellent magnetic properties.

The amorphous magnetic materials according to the present invention can be very suitably used as a magnetic head and a core for winding coil therearound, a magnetic shield, an electromagnet, or the like. The above-listed devices may be employed in an electronic computer, image transcribing device, and card reader, a reed switch or audio apparatuses. The magnetic head, core, for winding a coil therearound, magnetic shield and electro magnet mentioned above can be advantageously produced according to the present invention, without reducing the magnetic properties of the amorphous alloys. One process for producing such items comprises the steps of:

producing an amorphous magnetic alloy with one of its compositions chosen in accordance with the present invention, which alloy being in the form of films;

laminating these films to the required thickness, by using a bonding agent, and;

heating the laminated films to a thermosetting temperature of a resin of the bonding agent;

such temperature ranging from approximately 100° to approximately 200° C.

The present invention is explained in more detail by means of the following Examples.

EXAMPLE 1

Pure iron (purity of 99.9%), electrolytic cobalt (purity of 99.9%), Mond nickel (purity of 99.95%), silicon (purity of 99.99%) and crystalline boron were admixed in such an amount as to provide a composition of $(Fe_{0.08}Co_{0.62}Ni_{0.30})_{73}Si_{16}B_{11}$, and melted in a Tammann furnace in an argon atmosphere. The melted alloy was sucked into a quartz tube and rapidly cooled to obtain a mother alloy. Subsequently, this mother alloy was rapidly cooled at a rate of approximately $10^{6}$° C./sec by using the apparatus illustrated in FIG. 3. The amorphous alloy specimens were produced in the form of a ribbon having a thickness of 40 microns. These specimens were subjected to both X-ray diffraction and electron diffraction. However, no diffraction pattern showing a crystal structure of the alloy was observed at all.

The resultant specimens were then wound one upon the other in a toroidal form to provide a core for winding coils. The initial magnetic properties of the core for winding coils were measured. After heating the core for winding coils to a temperature of 200° C. for one hour, the magnetic properties of the wound core were then measured at room temperature. The measurement results are shown in Table 1.

Table 1

| Condition of Specimen | Initial Permeability μi(at 1KHz) | Coercive Force (Hc(mOe) | Density at Shift of B-H Hysteresis loop (mOe) | Magnetic Flux Magnetic Field of 10/Oe/.$B_{10}$(G) |
|---|---|---|---|---|
| Initial state | 38,600 | 7 | 0 | 5,600 |
| After heating to 200° C. × 1h | 38,900 | 7 | 0 | 5,600 |

As is clear from Table 1, the Specimen, $(Fe_{0.08}Co_{0.62}Ni_{0.30})_{78}Si_{16}B_{11}$, which contains 0.30 (molar fraction) of nickel and 27 atomic %, i.e., y=16+11, of the metalloid component, exhibits neither shift of its B-H hysteresis loop nor decrease in its initial permeability due to heating of the Specimen to 200° C. for one hour. Accordingly, the amorphous magnetic alloy provided by the present invention is shown to be thermally stable.

EXAMPLE 2

The procedure of Example 1 was repeated to produce amorphous alloys. These alloys exhibited compositional make-up which is almost free from magnetostriction and which is based on iron, cobalt, nickel, silicon, and boron, occasionally phosphorous and/or carbon. The magnetic properties of the amorphous alloys are shown in Table 2, with regard to both the initial state, i.e., as-quenched state, and the state after heating to a temperature of 200° C. for one hour.

Table 2

| | | Initial Value | | | After Heating to 200° C. for 1 hour | | | | |
|---|---|---|---|---|---|---|---|---|---|
| No. | Composition | Initial permeability μi(1 KHz) | Coercive force Hc(mOe) | Magnetic flux density at magnetic field of 10(Oe) $B_{10}$(G) | Initial permeability μi(1 kHz) | Δμi/μi (%) | Coercive force Hc(mOe) | Shift of B-H hysteresis loop (mOe) | Magnetic flux density at magnetic field of 10/Oe $B_{10}$(G) |
| *1 | $(Fe_{0.06}Co_{0.94})_{73}Si_{16}B_{11}$ | 9,620 | 23 | 7,600 | 1,250 | −87.0 | 73 | 57 | 7,600 |
| 2 | $(Fe_{0.05}Co_{0.95})_{72.5}Si_{16.5}B_{11}$ | 9,850 | 21 | 7,200 | 9,940 | + 9.1 | 21 | 0 | 7,200 |
| 3 | $(Fe_{0.04}Co_{0.96})_{69}Si_{18}B_{13}$ | 10,400 | 20 | 5,300 | 11,200 | + 7.7 | 20 | 0 | 5,300 |
| 4 | $(Fe_{0.03}Co_{0.97})_{65}Si_{21}B_{14}$ | 9,350 | 24 | 3,200 | 9,440 | + 9.6 | 23 | 0 | 3,200 |
| *5 | $(Fe_{0.08}Co_{0.72}NI_{0.20})_{76}Si_{15}B_{9}$ | 9,710 | 21 | 8,600 | 1,710 | −82.4 | 61 | 38 | ,8600 |
| 6 | $(Fe_{0.07}Co_{0.73}Ni_{0.20})_{74}Si_{16}B_{10}$ | 13,600 | 19 | 7,500 | 12,900 | − 5.1 | 19 | 0 | 7,500 |
| 7 | $(Fe_{0.05}Co_{0.75}Ni_{0.20})_{69}Si_{18}B_{13}$ | 12,800 | 19 | 3,400 | 13,500 | + 5.5 | 19 | 0 | 3,400 |
| *8 | $(Fe_{0.09}Co_{0.61}Ni_{0.30})_{76}Si_{15}B_{9}$ | 25,700 | 13 | 7,400 | 2,280 | −91.1 | 54 | 29 | 7,400 |
| 9 | $(Fe_{0.08}Co_{0.62}Ni_{0.30})_{73}Si_{16}B_{11}$ | 38,600 | 7 | 5,600 | 38,900 | + 0.8 | 7 | 0 | 5,600 |
| 10 | $(Fe_{0.07}Co_{0.63}Ni_{0.30})_{71}Si_{17}B_{12}$ | 42,900 | 6 | 3,500 | 43,600 | + 1.6 | 6 | 0 | 3,500 |
| *11 | $(Fe_{0.11}Co_{0.44}Ni_{0.45})_{73}Si_{13}B_{9}$ | 11,400 | 20 | 6,500 | 2,070 | −81.8 | 57 | 35 | 6,500 |
| 12 | $(Fe_{0.10}Co_{0.45}Ni_{0.45})_{76}Si_{15}B_{9}$ | 36,200 | 8 | 5,200 | 35,800 | + 1.1 | 8 | 0 | 5,200 |
| 13 | $(Fe_{0.09}Co_{0.40}Ni_{0.45})_{74}Si_{16}B_{10}$ | 47,500 | 6 | 3,200 | 46,900 | − 1.3 | 6 | 0 | 3,200 |
| *14 | $(Fe_{0.12}Co_{0.28}Ni_{0.60})_{78}Si_{13}B_{9}$ | 16,300 | 17 | 4,500 | 1,930 | −88.2 | 49 | 26 | 4,500 |

Table 2-continued

| No. | Composition | Initial Value: Initial permeability μi(1 KHz) | Initial Value: Coercive force Hc(mOe) | Initial Value: Magnetic flux density at magnetic field of 10(Oe) $B_{10}$(G) | After Heating to 200° C. for 1 hour: Initial permeability μi(1 kHz) | After Heating: Δμi/μi (%) | After Heating: Coercive force Hc(mOe) | After Heating: Shift of B-H hysteresis loop (mOe) | After Heating: Magnetic flux density at magnetic field of 10/Oe $B_{10}$(G) |
|---|---|---|---|---|---|---|---|---|---|
| 15 | $(Fe_{0.11}Co_{0.20}Ni_{0.60})_{77.3}Si_{13.7}B_9$ | 32,500 | 9 | 3,800 | 32,200 | − 0.9 | 9 | 0 | 3,800 |
| 16 | $(Fe_{0.10}Co_{0.30}Ni_{0.60})_{76.4}Si_{13.6}B_{10}$ | 41,700 | 6 | 3,000 | 42,500 | + 1.9 | 6 | 0 | 3,000 |
| 17 | $(Fe_{0.08}Co_{0.62}Ni_{0.30})_{73}Si_{10}B_{11}P_6$ | 35,700 | 8 | 5,400 | 36,900 | + 2.2 | 8 | 0 | 5,400 |
| 18 | $(Fe_{0.08}Co_{0.62}Ni_{0.30})_{73}Si_{10}B_{11}C_6$ | 32,600 | 9 | 5,300 | 31,800 | − 2.5 | 10 | 0 | 5,300 |
| 19 | $(Fe_{0.08}Co_{0.62}Ni_{0.30})_{73}Si_{10}B_5P_6C_6$ | 33,800 | 9 | 4,900 | 33,500 | − 0.9 | 9 | 0 | 4,900 |
| 20 | $(Fe_{0.08}Co_{0.62}Ni_{0.30})_{73}B_{27}$ | 24,900 | 13 | 6,100 | 24,100 | − 3.2 | 13 | 0 | 6,100 |
| 21 | $(Fe_{0.08}Co_{0.62}Ni_{0.30})_{73}Si_7B_{20}$ | 29,300 | 11 | 5,900 | 28,500 | − 2.7 | 11 | 0 | 5,900 |
| 22 | $(Fe_{0.08}Co_{0.62}Ni_{0.30})_{73}Si_{17}B_{16}$ | 33,100 | 19 | 5,700 | 34,200 | + 3.3 | 9 | 0 | 5,700 |
| 23 | $(Fe_{0.03}Co_{0.62}Ni_{0.30})_{73}Si_{20}B_7$ | 40,700 | 7 | 5,400 | 41,600 | + 2.2 | 6 | 0 | 5,400 |

Note:
Specimens with asterisk mark * do not fall within the scope of the present invention.

Specimens Nos. 1 through 4 correspond to the Fe—, Co—, Si—, B— based amorphous alloy which is free from Ni. In this alloy, when the total amounts of the metalloid components of Si and B are 27.5 atomic % or more, the alloy composition is thermally stable and shift of the B-H hysteresis loop due to heating of the alloy does not occur within this composition. However, when the total amounts of the metalloid component exceeds 35 atomic %, the value of the magnetic flux density is too low, for example, lower than 3500 Gauss, with the result being that the magnetic properties of the alloy are insufficient for producing magnetic materials. In the alloy free from Ni, thermally stable alloy compositions having excellent magnetic properties are provided when the total amount of metalloid components is from 27.5 to 35 atomic %, preferably from 27.5 to 32.0 atomic %.

Specimens Nos. 5 through 7 correspond to the Fe—, Co—, Ni—, Si— and B— based amorphous alloy containing 0.20 (molar fraction) of Ni. In this alloy composition, the alloy is thermally stable if the total amount of the metalloid components is 26 atomic % or more, while the magnetic flux density level is too low if the total amount is more than 31 atomic %. Accordingly, thermally stable alloy compositions having excellent magnetic properties are provided when the total amount of the metalloid components is from 26 to 31 atomic %, preferably from 26 to 30 atomic %.

Specimens Nos. 11 through 13 correspond respectively to amorphous alloys containing 0.45 (molar fraction) of Ni. In this alloy composition, the alloy is thermally stable if the total amount of the metalloid components is 24 atomic % or more, while the magnetic flux density level is too low if the total amount is more than 31%. Accordingly, thermally stable alloy compositions having excellent magnetic properties are provided when the total amount of the metalloid components is from 24 to 26 atomic %, preferably from 24 to 25 atomic %.

Specimens Nos. 14 through 16 correspond respectively to amorphous alloys containing 0.60 (molar fraction) of Ni. In this alloy composition the alloy is thermally stable if the total amount of the metalloid components is 22.7 atomic % or more, while the magnetic flux density level is too low if the total amount is more than 23.6%. Therefore, thermally stable alloy compositions having excellent magnetic properties are provided if the total amount of the metalloid components is from 22.7 to 23.6 atomic %, preferably from 23.0 to 23.6 atomic %. The following two relationships will be apparent from Specimens Nos. 1 through 16. In order to provide an amorphous alloy with thermal stability, the relationship between the total amount of the metalloid components and the content of nickel should be changed such that the total amount of the metalloid components is increased with a decrease in the nickel content in the alloy system. Furthermore, in order to provide the amorphous alloy system with a magnetic flux density appropriate for producing magnetic materials the relationship between the total amount of the metalloid components and the content of nickel should be changed such that the total amount of the metalloid components is decreased with an increase in the nickel content.

Specimens Nos. 17 through 19 correspond respectively to amorphous alloy compositions in which the Si or B is partially replaced with P and/or C. It is clear that by the partial replacement of Si or B with P and/or C, an excellent thermal stability of the amorphous alloy can be obtained.

Specimens Nos. 20 through 23 correspond respectively to the alloy compositions, in which the y value is equal to 27. In these specimens, the kind of metalloid components and the relative value of each of these components are respectively varied. Regardless of this variation, an excellent thermal stability of the amorphous alloy can still be obtained.

EXAMPLE 3

Figure 4:
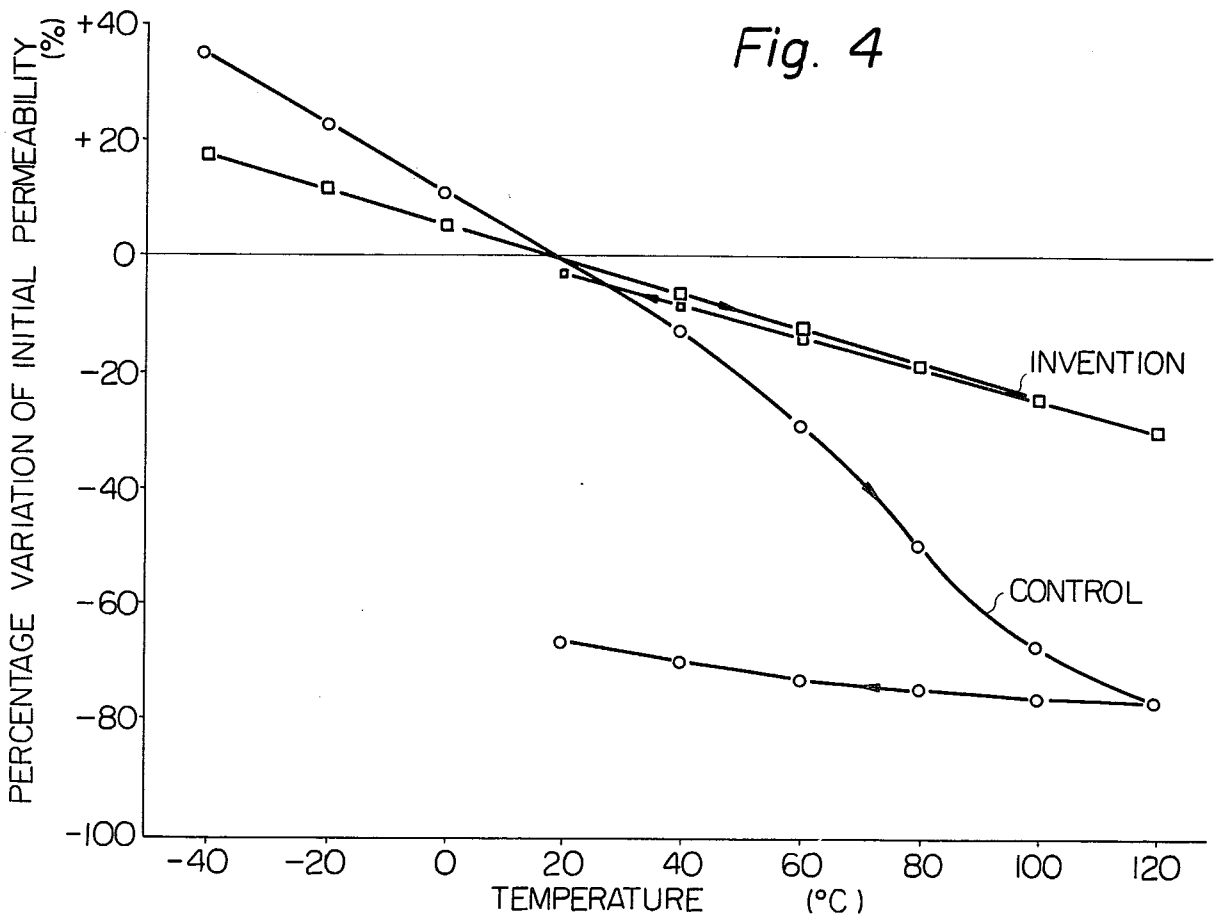
FIG. 4 is an illustration of the effect of 5% of Mo on the variation of initial permeability with heating.

The amorphous alloy according to the present invention having the composition $(Fe_{0.09}Co_{0.65}Ni_{0.26})_{75}Si_{15}B_{10}$ with the 5% of Mo as well as the control amorphous alloy having the composition $(Fe_{0.09}Co_{0.65}Ni_{0.26})_{75}Si_{15}B_{10}$ was produced by following the procedure of Example 1. The initial permeability of these alloys was measured under the following condition wherein the temperature during measurement was initially −40° C., increased to 120° C. and then decreased to room temperature. The results of such measurement are shown in FIG. 4, in which the abscissa indicates the temperature during measurement and the ordinate indicates a percentage variation of the measured initial permeability with respect to that at room temperature. As is clear from FIG. 4, the variation of the initial permeability is greater in the control amorphous magnetic alloy (denoted as Control in FIG. 4) than in the alloy of the present invention. In the control amorphous alloy, the initial permeability is lower during the period for decreasing the temperature during measurement from 120° C. than during the period for increasing the temperature up to 120° C. during measurement. Furthermore, the initial permeability at 20° C. during the temperature decreasing period is more than 60% of that during the temperature increasing period. Namely, the initial permeability of the control alloy is not reversed to the original value after reversion of the temperature during measurement to 20° C. On the other hand, according to the present invention, the dependence of the initial permeability upon temperature as well as the irreversible change of the initial permeability is essentially removed.

EXAMPLE 4

The procedure of Example 1 was repeated to produce amorphous alloy compositions, in which from 0 to 8 atomic % of Mo is added to the basic composition of $(Fe_{0.09}Co_{0.65}Ni_{0.26})_{76}Si_{15}B_{10}$ by using a metallic molybdenum with a purity of 99.9%. The results of the measurement of the magnetic properties are shown in Table 3.

Table 3

| Amount of Mo (at %) | Initial Value: Initial permeability μi KHz) | Initial Value: Coercive force HC(mOe) | Initial Value: Magnetic flux density at magnetic field of 10(Oe) $B_{10}$(G) | After Heating to 200° C. for 1 hour: Initial permeability μi(1 KHz) | After Heating: Δμi/μi (%) | After Heating: Coercive force Hc(mOe) | After Heating: Shift of B-H hysteresis loop (mOe) | After Heating: Magnetic flux density at magnetic field of 10/Oe/$B_{10}$(G) |
|---|---|---|---|---|---|---|---|---|
| 0 | 28,600 | 11 | 7,800 | 2,640 | −90.8 | 53 | 31 | 7,800 |
| 0.5 | 31,300 | 10 | 7,400 | 30,900 | − 1.3 | 10 | 0 | 7,400 |
| 1.0 | 33,700 | 9 | 6,800 | 32,500 | − 3.6 | 9 | 0 | 6,800 |
| 3.0 | 35,100 | 8 | 5,600 | 36,200 | + 3.1 | 7 | 0 | 5,600 |
| 5.0 | 34,900 | 8 | 4,200 | 33,700 | − 3.4 | 9 | 0 | 4,200 |
| 6.0 | 32,400 | 9 | 3,300 | 32,800 | + 1.2 | 9 | 0 | 3,300 |
| 8.0 | 30,500 | 10 | 1,900 | 31,600 | + 3.6 | 10 | 0 | 1,900 |

From Table 3, it is apparent that by the addition of 0.5% or more of Mo into the amorphous alloy, a decrease of the initial permeability caused by the heating of the amorphous alloy is prevented from occurring, with the result being that a thermally stable, amorphous magnetic material is provided. When the added amount of Mo exceeds 6%, the magnetic flux density of the amorphous alloy is found to be too low.

EXAMPLE 5

The procedure of Example 1 was repeated to produce amorphous alloy compositions, in which from 0 to 8 atomic % of Ge is added to the basic composition of $(Fe_{0.10}Co_{0.55}Ni_{0.35})_{75}Si_{15}B_{10}$. The results of the measurement of the magnetic properties are shown in Table 4.

Table 4

| Amount of Ge (at %) | Initial value: Initial permeability μi(1 KHz) | Initial value: Coercive force Hc(mOe) | Initial value: Magnetic flux density at magnetic field of 10(Oe) $B_{10}$(G) | Dependence of Initial Permeability upon temperature: Variation at −40° C. (%) | Dependence: Variation at +100° C. (%) | After Heating to 200° C. for 1 hour: Initial Permeability μi(1 KHz) | After Heating: Δμi/μi (%) | After Heating: Coercive force HC(mOe) | After Heating: Shift of B-H hysteresis loop (mOe) | After Heating: Magnetic flux density at magnetic field of 10/Oe/$B_{10}$(G) |
|---|---|---|---|---|---|---|---|---|---|---|
| 0 | 32,800 | 9 | 6,300 | +44.1 | −59.3 | 30,700 | −6.4 | 10 | 16 | 6,300 |
| 0.5 | 36,700 | 8 | 5,800 | +38.6 | −50.8 | 36,100 | −1.6 | 8 | 0 | 5,800 |
| 1.0 | 38,200 | 7 | 5,500 | +35.2 | −45.5 | 38,500 | +0.8 | 7 | 0 | 5,500 |
| 3.0 | 38,600 | 7 | 4,400 | +27.5 | −35.6 | 37,900 | −1.8 | 7 | 0 | 4,400 |
| 5.0 | 36,100 | 8 | 3,000 | +21.4 | −27.3 | 36,800 | +1.9 | 8 | 0 | 3,000 |
| 8.0 | 31,400 | 10 | 900 | +16.0 | −21.2 | 30,600 | −2.5 | 10 | 0 | 900 |

Since the Ni content of $(Fe_{0.10}Co_{0.55}Ni_{0.35})_{75}Si_{15}B_{10}$ is higher than the Ni content of the alloy composition of Example 4, the Specimen without the Ge addition has a small B–H hysteresis loop shift after heating. Since the magnetic properties of this Specimen cannot be deteriorated by heating, it is possible to provide, without the addition of Ge, relatively stable magnetic properties for producing an amorphous magnetic material. However, as is clear from Table 4, one of the features of the addition of Ge to the amorphous alloy is that the dependence of the initial permeability upon temperature is decreased when the amount of the added Ge is increased. It is, therefore, possible to provide a further improved amorphous magnetic material, which possesses an excellent initial permeability which is dependent upon the temperature.

EXAMPLE 6

The amount of several or all of the elements Fe, Co, Ni, Si, B and P, is determined to be such that the amorphous alloy compositions consisting of these elements are free from the effects of magnetostriction. These alloy compositions with or without an added element were produced by following the procedure of Example 1. The magnetic properties of these alloy compositions are shown in Table 5 with regard to the as-quenched state (designated as Initial Value in the Table) and the state after heating to a temperature of 200° C. for one hour.

Table 5

| No. | Composition | Initial Value: Initial permeability μi(1 KHz) | Initial Value: Coercive force Hc(mOe) | Initial Value: Magnetic flux density at magnetic field of 10(Oe) $B_{10}$(G) | Initial Value: Dependence of Initial permeability upon temperature: variatin at −40° C. | Initial Value: Dependence of Initial permeability upon temperature: variation at +100° C. | After Heating to 200° C. for 1 hour: Initial permeability μi(1 KHz) | After Heating: Δμi/μi (%) | After Heating: Coercive force Hc(mOe) | After Heating: Shift of B-H hystersis loop (mOe) | After Heating: Magnetic flux density at magnetic field of 10/Oe $B_{10}$(G) |
|---|---|---|---|---|---|---|---|---|---|---|---|
| *101 | $(Fe_{0.06}Co_{0.94})_{75}Si_{15}B_{10}$ | 9,270 | 25 | 8,500 | — | — | 1,070 | −88.5 | 75 | 63 | 8,500 |
| *102 | $(Fe_{0.06}Co_{0.94})_{75}Si_{15}B_{10}$ + $Mo_5$ | 13,100 | 19 | 4,700 | — | — | 1,960 | −85.0 | 59 | 35 | 4,700 |
| *103 | $(Fe_{0.06}Co_{0.94})_{75}Si_{15}B_{10}$ + $Mo_8$ | 11,400 | 20 | 2,500 | — | — | 2,530 | −77.8 | 42 | 29 | 2,500 |
| *104 | $(Fe_{0.07}Co_{0.85}Ni_{0.08})_{75}Si_{15}B_{10}$ | 11,200 | 20 | 9,200 | — | — | 1,630 | −85.4 | 65 | 41 | 9,200 |
| 105 | $(Fe_{0.07}Co_{0.85}Ni_{0.08})_{75}Si_{15}B_{10}$ + $Mo_5$ | 12,600 | 19 | 5,300 | +19.7 | −26.0 | 11,800 | − 6.3 | 20 | 0 | 5,400 |
| 106 | $(Fe_{0.07}Co_{0.85}Ni_{0.08})_{75}Si_{15}B_{10}$ + $Mo_8$ | 14,800 | 18 | 2,900 | +11.3 | −15.1 | 15,100 | + 2.0 | 18 | 0 | 2,900 |
| *107 | $(Fe_{0.08}Co_{0.75}Ni_{0.17})_{75}Si_{15}B_{10}$ | 12,400 | 19 | 8,500 | — | — | 2,180 | −82.4 | 58 | 36 | 8,500 |
| 108 | $(Fe_{0.08}Co_{0.75}Ni_{0.17})_{75}Si_{15}B_{10}$ + $Mo_5$ | 13,900 | 18 | 4,900 | +20.5 | −26.9 | 14,600 | + 5.0 | 18 | 0 | 4,900 |
| 109 | $(Fe_{0.08}Co_{0.75}Ni_{0.17})_{75}Si_{15}B_{10}$ + $Mo_8$ | 15,100 | 18 | 2,700 | +13.1 | −17.8 | 14,500 | − 4.0 | 18 | 0 | 2,700 |
| *110 | $(Fe_{0.09}Co_{0.65}Ni_{0.26})_{75}Si_{15}B_{10}$ | 28,600 | 11 | 7,800 | — | — | 2,640 | −90.8 | 53 | 31 | 7,800 |
| 111 | $(Fe_{0.09}Co_{0.65}Ni_{0.26})_{75}Si_{15}Bi_{10}$ + $Mo_5$ | 34,900 | 8 | 4,200 | +21.0 | −27.1 | 33,700 | − 3.4 | 9 | 0 | 4,200 |
| 112 | $(Fe_{0.09}Co_{0.65}Ni_{0.26})_{75}Si_{15}B_{10}$ +$Mo_8$ | 30,500 | 10 | 1,900 | +14.5 | −19.3 | 31,600 | + 3.6 | 10 | 0 | 1,900 |
| *113 | $(Fe_{0.11}Co_{0.40}Ni_{0.49})_{75}Si_{15}B_{10}$ | 36,700 | 8 | 5,200 | +48.3 | −64.2 | 35,800 | − 2.4 | 8 | 0 | 5,200 |
| 114 | $(Fe_{0.11}Co_{0.40}Ni_{0.49})_{75}Si_{15}B_{10}$ + $Mo_1$ | 38,200 | 7 | 4,500 | +39.8 | −51.4 | 38,400 | + 0.5 | 7 | 0 | 4,500 |
| 115 | $(Fe_{0.11}Co_{0.40}Ni_{0.49})_{75}Si_{15}B_{10}$ + $Mo_3$ | 34,600 | 8 | 3,000 | +25.7 | −33.6 | 35,100 | + 1.4 | 8 | 0 | 3,000 |
| *116 | $(Fe_{0.12}Co_{0.65}Ni_{0.23})_{80}Si_{12}B_8$ | 19,300 | 16 | 9,500 | — | — | 2,510 | −87.0 | 57 | 34 | 9,500 |
| 117 | $(Fe_{0.12}Co_{0.65}Ni_{0.23})_{80}Si_{12}B_8$ + $Mo_5$ | 26,500 | 12 | 5,800 | — | — | 24,900 | − 6.0 | 13 | 0 | 5,800 |
| 118 | $(Fe_{0.12}Co_{0.65}Ni_{0.23})_{80}Si_{12}B_8$ + $Mo_8$ | 27,900 | 12 | 2,900 | — | — | 27,500 | − 1.4 | 12 | 0 | 2,900 |
| *119 | $(Fe_{0.04}Co_{0.65}Ni_{0.31})_{65}Si_{12}B_{14}$ | 36,100 | 8 | 5,300 | — | — | 35,200 | − 2.5 | 8 | 0 | 5,800 |
| 120 | $(Fe_{0.04}Co_{0.65}Ni_{0.31})_{65}Si_{21}B_{14}$ + $Mo_1$ | 34,400 | 9 | 3,800 | — | — | 35,400 | + 2.9 | 8 | 0 | 3,800 |
| 121 | $(Fe_{0.09}Co_{0.65}Ni_{0.26})_{75}Si_{15}B_{10}$ + $Ti_5$ | 27,600 | 12 | 4,500 | +17.9 | −23.0 | 26,100 | − 5.4 | 12 | 0 | 4,500 |
| 122 | $(Fe_{0.09}Co_{0.65}Ni_{0.26})_{75}Si_{15}B_{10}$ + $Zr_5$ | 26,300 | 12 | 4,300 | +17.4 | −22.3 | 25,200 | − 4.2 | 13 | 0 | 4,300 |
| 123 | $(Fe_{0.09}Co_{0.65}Ni_{0.26})_{75}Si_{15}B_{10}$ + $V_5$ | 32,700 | 9 | 4,100 | +20.1 | −25.9 | 30,400 | − 7.0 | 10 | 0 | 4,100 |
| 124 | $(Fe_{0.09}Co_{0.65}Ni_{0.26})_{75}Si_{15}B_{10}$ + $Nb_5$ | 31,000 | 10 | 4,200 | +19.4 | −24.9 | 31,700 | + 2.2 | 10 | 0 | 4,200 |
| 125 | $(Fe_{0.09}Co_{0.65}Ni_{0.26})_{75}Si_{15}B_{10}$ + $Ta_5$ | 32,900 | 9 | 4,500 | +20.2 | −26.0 | 31,300 | − 4.9 | 10 | 0 | 4,500 |
| 126 | $(Fe_{0.09}Co_{0.65}Ni_{0.26})_{75}Si_{15}B_{10}$ + $Cr_5$ | 30,100 | 10 | 4,400 | +19.0 | −24.4 | 29,600 | − 1.7 | 11 | 0 | 4,400 |
| 127 | $(Fe_{0.09}Co_{0.65}Ni_{0.26})_{75}Si_{15}B_{10}$ + $W_5$ | 35,400 | 8 | 4,100 | +21.4 | −27.4 | 35,700 | + 0.8 | 8 | 0 | 4,100 |
| 128 | $(Fe_{0.09}Co_{0.65}Ni_{0.26})_{75}Si_{15}B_{10}$ + $Zn_5$ | 31,700 | 10 | 4,300 | +19.7 | −25.3 | 30,600 | − 3.5 | 10 | 0 | 4,300 |
| 129 | $(Fe_{0.09}Co_{0.65}Ni_{0.26})_{75}Si_{15}B_{10}$ + $Al_5$ | 33,800 | 9 | 4,100 | +20.6 | −26.5 | 32,900 | − 2.7 | 10 | 0 | 4,100 |
| 130 | $(Fe_{0.09}Co_{0.65}Ni_{0.26})_{75}Si_{15}B_{10}$ + $Ga_5$ | 29,300 | 11 | 4,000 | +18.7 | −24.0 | 28,100 | − 4.1 | 11 | 0 | 4,000 |
| 131 | $(Fe_{0.09}Co_{0.65}Ni_{0.26})_{75}Si_{15}B_{10}$ + $In_5$ | 27,500 | 12 | 4,200 | +17.5 | −23.0 | 26,400 | − 4.0 | 12 | 0 | 4,200 |
| 132 | $(Fe_{0.09}Co_{0.65}Ni_{0.26})_{75}Si_{15}B_{10}$ + $Sn_5$ | 33,600 | 9 | 4,100 | +20.5 | −26.4 | 34,200 | + 1.8 | 8 | 0 | 4,100 |
| 133 | $(Fe_{0.09}Co_{0.65}Ni_{0.26})_{75}Si_{15}B_{10}$ + $Pb_5$ | 27,700 | 12 | 4,200 | +18.0 | −23.1 | 26,300 | − 5.0 | 13 | 0 | 4,200 |
| 134 | $(Fe_{0.09}Co_{0.65}Ni_{0.26})_{75}Si_{15}B_{10}$ + $As_5$ | 25,400 | 13 | 4,300 | +17.0 | −21.8 | 24,600 | − 3.1 | 13 | 0 | 4,300 |
| 135 | $(Fe_{0.09}Co_{0.65}Ni_{0.26})_{75}Si_{15}B_{10}$ + $Sb_5$ | 23,900 | 14 | 4,200 | +16.4 | −21.0 | 25,100 | + 5.0 | 13 | 0 | 4,200 |
| 136 | $(Fe_{0.09}Co_{0.65}Ni_{0.26})_{75}Si_{15}B_{10}$ + $Bi_5$ | 25,800 | 13 | 4,500 | +17.2 | −22.0 | 26,800 | + 3.9 | 12 | 0 | 4,500 |
| 137 | $(Fe_{0.09}Co_{0.65}Ni_{0.26})_{75}Si_{15}B_{10}$ + $(Ti + Mo)_5$ | 32,300 | 9 | 4,300 | — | — | 31,500 | − 2.5 | 10 | 0 | 4,300 |
| 138 | $(Fe_{0.09}Co_{0.65}Ni_{0.26})_{75}Si_{15}B_{10}$ + $(Ta + Al)_5$ | 29,100 | 11 | 4,200 | — | — | 30,300 | + 4.1 | 11 | 0 | 4,200 |
| 139 | $(Fe_{0.09}Co_{0.65}Ni_{0.26})_{75}Si_{15}B_{10}$ + $(Nb + Ge)_5$ | 33,500 | 9 | 4,600 | — | — | 34,400 | + 2.7 | 9 | 0 | 4,600 |
| 140 | $(Fe_{0.09}Co_{0.65}Ni_{0.26})_{75}Si_{15}B_{10}$ + $(W + Sb)_5$ | 27,400 | 12 | 4,400 | — | — | 29,700 | + 8.4 | 11 | 0 | 4,400 |
| 141 | $(Fe_{0.09}Co_{0.65}Ni_{0.26})_{75}Si_{15}B_{10}$ + $(Cr + Sn)_5$ | 34,200 | 9 | 4,700 | — | — | 32,900 | − 3.8 | 9 | 0 | 4,700 |
| 142 | $(Fe_{0.09}Co_{0.65}Ni_{0.26})_{75}B_{25}$ + $Mo_5$ | 21,300 | 15 | 5,100 | — | — | 20,600 | − 3.3 | 15 | 0 | 5,100 |
| 143 | $(Fe_{0.09}Co_{0.65}Ni_{0.26})_{75}Si_5B_{20}$ + $Mo_5$ | 26,800 | 12 | 4,800 | — | — | 25,700 | − 4.1 | 12 | 0 | 4,800 |
| 144 | $(Fe_{0.09}Co_{0.65}Ni_{0.26})_{75}Si_{10}B_{15}$ + $Mo_5$ | 32,500 | 9 | 4,500 | — | — | 33,800 | + 4.0 | 9 | 0 | 4,500 |
| 145 | $(Fe_{0.09}Co_{0.65}Ni_{0.26})_{75}Si_{20}B_5$ + $Mo_5$ | 21,400 | 15 | 4,100 | — | — | 21,100 | − 1.4 | 15 | 0 | 4,100 |

Table 5-continued

| No. | Composition | Initial Value: Initial permeability μi(1 KHz) | Initial Value: Coercive force Hc(mOe) | Initial Value: Magnetic flux density at magnetic field of 10(Oe) $B_{10}$(G) | Initial Value: Dependence of Initial permeability upon temperature: variatin at −40° C. | Initial Value: Dependence of Initial permeability upon temperature: variation at +100° C. | After Heating to 200° C. for 1 hour: Initial permeability μi(1 KHz) | After Heating to 200° C. for 1 hour: Δμi/μi (%) | After Heating to 200° C. for 1 hour: Coercive force Hc(mOe) | After Heating to 200° C. for 1 hour: Shift of B-H hystersis loop (mOe) | After Heating to 200° C. for 1 hour: Magnetic flux density at magnetic field of 10/Oe $B_{10}$(G) |
|---|---|---|---|---|---|---|---|---|---|---|---|
| 146 | $(Fe_{0.09}Co_{0.65}Ni_{0.26})_{75}Si_8B_{10}P_5 + Mo_5$ | 28,500 | 11 | 4,300 | — | — | 29,300 | + 2.8 | 11 | 0 | 4,300 |
| 147 | $(Fe_{0.09}Co_{0.65}Ni_{0.26})_{75}Si_8B_5P_7C_5 + Mo_5$ | 27,300 | 12 | 4,500 | — | — | 26,500 | − 2.9 | 12 | 0 | 4,500 |

Note:
[1]Variation of the initial permeability depending upon the temperature indicates variation with respect to the initial permeability at 20° C. as the standard.
[2]Specimens with an asterisk mark (*) do not fall within the scope of the present invention.

The following facts will be apparent from Table 5.

(1) The B–H hysteresis loop shifts due to the heating of the alloy composition in the following cases. Namely, the amount of Co (b) is 0.94 (Samples 102 and 103), and none of the additive metals is added (Samples 101, 107, 113, 116 and 119).

(2) The hysteresis loop is not shifted and both the value $\Delta\mu i/\mu i$ and the dependence of the initial permeability upon temperature are low when one or more of additive metals are used.

(3) The effects of the use of additive metals, described in item (2), above, are substantially the same with regard to different kinds of additive metals.

(4) The magnetic flux density is decreased to a relatively low value, but the initial permeability can be increased, when the added amount of Mo is as high as 8 atomic %.

(5) From the comparisons of Specimens Nos. 122 through 136 with one another, the effects of the additive elements are found to be substantially the same, except that the effects on the initial permeability $\mu i$ and $\Delta\mu i/\mu i$ are slightly different between these additive elements. W and Sn are the primary preferable elements, and Cr and Nb are the secondary preferable elements in the additive metals, from a point of view of initial permeability.

(6) When the Co content is lower than 0.70, the initial permeability is high. Therefore, it desirable that the Co content for the amorphous magnetic material with high permeability be in the range of from 0.40 to 0.70.

What we claim is:

1. An essentially amorphous, magnetic alloy having stable magnetic properties after heating to a temperature in the range of 100° to 200° C. said alloy having the general formula:

$$(Fe_aCo_bNi_c)_x(Si_eB_f)_y,$$

wherein, a, b and c are the molar fractions of iron, cobalt and nickel, respectively, wherein a+b+c=1.00; e and f are the molar fractions of silicon and boron, respectively, wherein e+f=1.00; x is the atomic percent of iron, cobalt and nickel; and y is an atomic percent of silicon and boron, based on the alloy, respectively, and, wherein a, c, e, f and y are defined by the following relationships:

$$0.03 \leqq a \leqq 0.12$$

$$0 \leqq c \leqq 0.60$$

$$27.5-8c \leqq y \leqq 35-19c$$

$$0 \leqq ey \leqq 25, \text{ and}$$

$$0 \leqq fy \leqq 30.$$

2. An alloy according to claim 1, wherein said values a, c, e and y are defined by the following relationships:

$$0.04 \leqq a \leqq 0.09$$

$$0 \leqq c \leqq 0.30, \text{ and}$$

$$5 \leqq ey \leqq 20.$$

3. An essentially amorphous, magnetic alloy having stable magnetic properties after heating to a temperature in the range of 100° to 200° C. said alloy having the general formula:

$$(Fe_aCo_bNi_c)_x(Si_eB_fP_gC_h)_y,$$

wherein, a, b and c are the molar fractions of iron, cobalt and nickel, respectively, wherein a+b+c=1.00; e, f, g and h are the molar fractions of silicon, boron, phosphorous and carbon, respectively, wherein e+f+g+h=1.00; x is the atomic % of iron, cobalt and nickel; and y is the atomic % of silicon, boron, phosphorous and carbon based on the alloy, respectively and, a, c, e, f, g and h and y are defined by the following relationships:

$$0.03 \leqq a \leqq 0.12;$$

$$0 \leqq c \leqq 0.60;$$

$$27.5-8c \leqq y \leqq 35-19c;$$

$$0 \leqq ey \leqq 25;$$

$$0 \leqq fy \leqq 30, \text{ and};$$

$$0 < (g+h) < 0.8(e+f).$$

4. An alloy according to claim 3, wherein a, c, e, y, g and h are defined by the following relationships:

$$0.04 \leqq a \leqq 0.09$$

$$0 \leqq c \leqq 0.30$$

$$5 \leqq ey \leqq 20, \text{ and}$$

$$0 < (g+H) < 0.5(e+f).$$

5. An essentially amorphous magnetic alloy having stable magnetic properties after heating to a temperature in the range of 100° to 200° C. and which has a reduced irreversible dependence of the initial permeability over a temperature range of −40° C. to 120° C., said alloy having the general formula:

$$(Fe_aCo_bNi_c)_x\,(Si_eB_f)_y,$$

wherein, a, b and c are the molar fractions of iron, cobalt and nickel, respectively, wherein a+b+c=1.00; e and f are the molar fractions of silicon and boron, respectively, wherein e+f=1.00; x is the atomic % of iron cobalt and nickel and y is the atomic % of silicon and boron, respectively, based on the composition expressed by said general formula, and, further, said values a, b, e, f and y are defined by the following relationships:

$$0.03 \leqq a \leqq 0.12;$$

$$0.40 \leqq b \leqq 0.85;$$

$$20 \leqq y \leqq 35;$$

$$0 \leqq ye \leqq 25, \text{ and};$$

$$0 < fy \leqq 30;$$

and, wherein at least one element selected from the group consisting of Ti, Zr, V, Nb, Ta, Cr, Mo, W, Zn, Al, Ga, In, Ge, Sn, Pb, As, Sb and Bi in an amount from 0.5 to 6.0 atomic % based on the total components of the amorphous alloy is present in said alloy expressed by said general formula.

6. An alloy according to claim 5, wherein said values a, b, e and y are defined by the following relationships:

$$0.04 \leqq a \leqq 0.09$$

$$0.40 \leqq b \leqq 0.70, \text{ and}$$

$$5 \leqq ey \leqq 20,$$

and the content of said at least one element is from 0.5 to 3.0 atomic %.

7. An essentially amorphous, magnetic alloy having stable magnetic properties after heating to a temperature in the range of 100° to 200° C. and which has a reduced irreversible dependence of the initial permeability over a temperature range of −40° C. to 120° C. said alloy having the general formula:

$$(Fe_aCo_bNi_c)_x(Si_eB_fP_gC_h)_y,$$

wherein, a, b and c are the molar fractions of iron, cobalt and nickel, respectively, wherein a+b+c=1.00; e, f, g and h are the molar fractions of silicon, boron, phosphorous and carbon, respectively, wherein e+f+g+h=1.00; x is the atomic % of iron, cobalt and nickel; and y is the atomic % of silicon, boron, phosphorous and carbon based on the alloy respectively, and said values a, c, e, f, g, h and y are defined by the following relationships:

$$0.03 \leqq a \leqq 0.12;$$

$$0.40 \leqq b \leqq 0.85;$$

$$0 \leqq ey \leqq 25;$$

$$0 \leqq fy \leqq 30, \text{ and};$$

$$0 < (g+h) \leqq 0.8(e+f),$$

and, wherein at least one element selected from the group consisting of Ti, Zr, V, Nb, Ta, Cr, Mo, W, Zn, Al, Ga, In, Ge, Sn, Pb, As, Sb and Bi in an amount from 0.5 to 6.0 atomic % based on the total components of the amorphous alloy is present in said alloy expressed by said general formula.

8. An alloy according to claim 7, wherein said values a, b, e, y, g and h are defined by the following relationships:

$$0.04 \leqq a \leqq 0.09$$

$$0.40 \leqq b \leqq 0.70$$

$$5 \leqq ey \leqq 20$$

$$0 < (g+h) \leqq 0.50(e+f),$$

and the content of said at least one element is form 0.5 to 3.0 atomic %.

9. Alloys of claim 1 of the formula $$(Fe_{0.07\text{-}0.08}Co_{0.62\text{-}0.63}Ni_{0.30})_{71\text{-}73}(Si_eB_f)_{27\text{-}29}$$

wherein e and f are the molar fractions of Si and B, respectively.

10. Alloys of claim 1 of the formula $$(Fe_{0.09\text{-}0.10}Co_{0.30\text{-}0.46}Ni_{0.45\text{-}0.60})_{76\text{-}74}(Si_eB_f)_{24\text{-}26}$$

wherein e and f are the molar fractions of Si and B, respectively.

11. An alloy of claim 1 of the formula $$(Fe_{0.05}Co_{0.95})_{72.5}Si_{16.5}B_{11}$$

12. An alloy of claim 1 of the formula $$(Fe_{0.04}Co_{0.96})_{69}Si_{18}B_{13}$$

13. An alloy of claim 1 of the formula $$(Fe_{0.03}Co_{0.97})_{65}Si_{21}B_{14}$$

14. An alloy of claim 1 of the formula $$(Fe_{0.07}Co_{0.73}Ni_{0.20})_{74}Si_{16}B_{10}$$

15. An alloy of claim 1 of the formula $$(Fe_{0.05}Co_{0.75}Ni_{0.20})_{69}Si_{18}B_{13}$$

16. An alloy of claim 1 of the formula $$(Fe_{0.08}Co_{0.62}Ni_{0.30})_{73}Si_{16}B_{11}$$

17. An alloy of claim 1 of the formula $$(Fe_{0.07}Co_{0.63}Ni_{0.30})_{71}Si_{17}B_{12}$$

18. An alloy of claim 1 of the formula $$(Fe_{0.10}Co_{0.45}Ni_{0.45})_{76}Si_{15}B_9$$

19. An alloy of claim 1 of the formula $$(Fe_{0.09}Co_{0.40}Ni_{0.45})_{74}Si_{16}B_{10}$$

20. An alloy of claim 1 of the formula $$(Fe_{0.11}Co_{0.20}Ni_{0.60})_{77.3}Si_{13.7}B_9$$

21. An alloy of claim 1 of the formula $$(Fe_{0.10}Co_{0.30}Ni_{0.60})_{76.4}Si_{13.6}B_{10}$$

22. An alloy of claim 3 of the formula $$(Fe_{0.08}Co_{0.62}Ni_{0.30})_{73}Si_{10}B_{11}P_6$$

23. An alloy of claim 3 of the formula $$(Fe_{0.08}Co_{0.62}Ni_{0.30})_{73}Si_{10}B_{11}C_6$$

24. An alloy of claim 3 of the formula $$(Fe_{0.08}Co_{0.62}Ni_{0.30})_{73}Si_{10}B_5P_6C_6$$

25. An alloy of claim 1 of the formula $$(Fe_{0.08}Co_{0.62}Ni_{0.30})_{73}B_{27}$$

26. An alloy of claim 1 of the formula $$(Fe_{0.08}Co_{0.62}Ni_{0.30})_{73}Si_7B_{20}$$

27. An alloy of claim 1 of the formula $(Fe_{0.08}Co_{0.62}Ni_{0.30})_{73}Si_{17}B_{16}$ 28. An alloy of claim 1 of the formula $(Fe_{0.03}Co_{0.62}Ni_{0.30})_{73}Si_{20}B_{7}$ 29. Alloys of claim 5 of the formula $(Fe_{0.07}Co_{0.85}Ni_{0.08})_{75}Si_{15}B_{10}Mo_{5-8}$ 30. Alloys of claim 5 of the formula $(Fe_{0.08}Co_{0.75}Ni_{0.17})_{75}Si_{15}B_{10}Mo_{5-8}$ 31. Alloys of claim 5 of the formula $(Fe_{0.09}Co_{0.75}Ni_{0.26})_{75}Si_{15}B_{10}Mo_{5-8}$ 32. Alloys of claim 5 of the formula $(Fe_{0.11}Co_{0.40}Ni_{0.49})_{75}Si_{15}B_{10}Mo_{1-3}$ 33. Alloys of claim 5 of the formula $(Fe_{0.12}Co_{0.65}Ni_{0.23})_{80}Si_{12}B_{8}Mo_{5-8}$ 34. An alloy of claim 5 of the formula $(Fe_{0.04}Co_{0.65}Ni_{0.31})_{65}Si_{21}B_{14}Mo_{1}$ 35. Alloys of claim 5 of the formula $(Fe_{0.09}Co_{0.65}Ni_{0.26})_{75}Si_{15}B_{10}Z_{5}$ wherein Z is an element selected from the group consisting of Ti, Zr, V, Nb, Ta, Cr, W, Zn, Al, Ga, In, Sn, Pb, As, Sb and Bi.

36. Alloys of claim 5 of the formula $(Fe_{0.09}Co_{0.65}Ni_{0.26})_{75}Si_{15}B_{10}X_{5}$ wherein X is a combination of elements selected from the group consisting of (Ti+Mo), (Ta+Al), (Nb+Ge), (W+Sb) and (Cr'Sn).

37. An alloy of claim 5 of the formula $(Fe_{0.09}Co_{0.65}Ni_{0.26})_{75}B_{25}Mo_{5}$ 38. An alloy of claim 5 of the formula $(Fe_{0.09}Co_{0.65}Ni_{0.26})_{75}Si_{5}B_{20}Mo_{5}$ 39. An alloy of claim 5 of the formula $(Fe_{0.09}Co_{0.65}Ni_{0.26})_{75}Si_{10}B_{15}Mo_{5}$ 40. An alloy of claim 5 of the formula $(Fe_{0.09}Co_{0.65}Ni_{0.26})_{75}Si_{20}B_{5}Mo_{5}$ 41. An alloy of claim 7 of the formula $(Fe_{0.09}Co_{0.65}Ni_{0.26})_{75}Si_{8}B_{10}P_{5}Mo_{5}$ 42. An alloy of claim 7 of the formula $(Fe_{0.09}Co_{0.65}Ni_{0.26})_{75}Si_{8}B_{5}P_{7}C_{5}Mo_{5}$

* * * * *

UNITED STATES PATENT OFFICE
CERTIFICATE OF CORRECTION

Patent No. 4,188,211 Dated February 12, 1980

Inventor(s) Norishige Yamaguchi, et al

It is certified that error appears in the above-identified patent and that said Letters Patent are hereby corrected as shown below:

Column 3, line 1: Change "another" to --, therefore, an--.

line 49: "$0.03 > a \leqq 0.12$" should be --$0.03 \leqq a \leqq 0.12$--.

Column 6, line 60: "According" should be --Accordingly--.

Column 10, Table 1, in the heading of the 4th column: Delete "Density at".

in the heading of the last column: Between "Magnetic Flux" and "Magnetic" insert --Density at--.

Column 20, line 25: "$0 < (g+h) < 0.8(e+f)$" should be -- $0 < (g+h) \leqq 0.8(e+f)$ --.

line 35: "$0 < (g+H) < 0.5(e+f)$" should be -- $0 < (g+H) \leqq 0.5(e+f)$--.

Signed and Sealed this

*Nineteenth* Day of *August 1980*

[SEAL]

*Attest:*

SIDNEY A. DIAMOND

*Attesting Officer* *Commissioner of Patents and Trademarks*